United States Patent [19]

Schleimann-Jensen

[11] Patent Number: 4,890,554

[45] Date of Patent: Jan. 2, 1990

[54] SYSTEM FOR GUIDING A FLYING OBJECT TOWARDS A TARGET

[76] Inventor: Lars J. Schleimann-Jensen, Ekbacksvägen 33A, 182 34 Danderyd, Sweden

[21] Appl. No.: 168,850

[22] Filed: Mar. 16, 1988

[30] Foreign Application Priority Data

Mar. 20, 1987 [SE] Sweden ..... 8701160

[51] Int. Cl.[4] ..... F42B 13/00; F42G 9/00

[52] U.S. Cl. ..... 102/384; 244/3.21

[58] Field of Search ..... 102/384, 388, 501; 244/3.21, 3.28, 3.3

[56] References Cited

U.S. PATENT DOCUMENTS

| | | | |
|---|---|---|---|
| 2,044,819 | 6/1936 | Taylor | 102/388 |
| 2,424,193 | 7/1947 | Rost et al. | 102/384 |
| 2,425,558 | 8/1947 | Ohlendorf | 102/384 |
| 4,210,298 | 7/1980 | Liberman | 244/3.21 |
| 4,296,894 | 10/1981 | Schnäbele et al. | 244/3.27 |
| 4,568,040 | 2/1986 | Metz | 102/384 |
| 4,601,442 | 7/1986 | Friedel et al. | 244/3.24 |
| 4,624,424 | 11/1986 | Pinson | 102/384 |
| 4,664,339 | 5/1987 | Crossfield | 244/3.28 |
| 4,709,877 | 12/1987 | Goulding | 244/3.28 |
| 4,711,178 | 12/1987 | Argyrakis | 102/384 |

*Primary Examiner*—David H. Brown

*Attorney, Agent, or Firm*—Pollock, Vande Sande & Priddy

[57] ABSTRACT

The invention relates to a system for guiding of a projectile towards a target and a projectile for carrying out the system. The projectile has means for guiding the projectile towards a desired target, e.g. by means of control signal from a target seeker. In a given point of the projectile trajectory blades or wings are swung-out from the projectile body, which blades in swung-out position are shaped as a propeller so that they are driven by the stream of air passing the projectile. In order to guide the projectile towards the target in the final phase of the trajectory the said blades are then adjusted in dependence upon the control signal from the target seeker. In one embodiment, in which the blades are rotatably journalled on the projectile body, the rotational axis of the blades is set in a given angle relative to the length axis of the projectile. This oblique setting between the rotational axis and length axis then will produce a desired force in lateral direction on the projectile. In other embodiments the blade angle, i.e. the angle between the length axis of each individual blade and the rotational axis, or the angle of incidence, i.e. the angular setting of each individual blade around its own length axis, is varied periodically in rhythm with the rotation of the blades in space.

4 Claims, 2 Drawing Sheets

Fig. 3
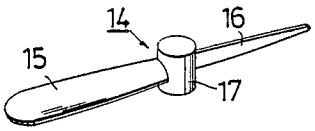
Fig. 4a
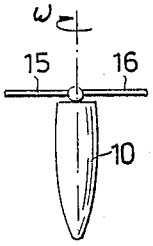
Fig. 5a
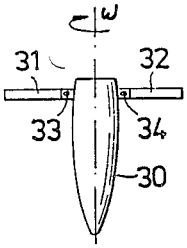
Fig. 6a
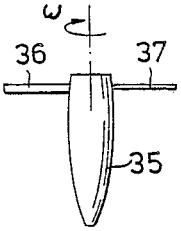
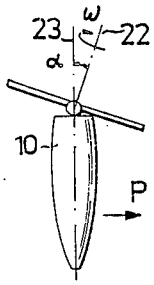
Fig. 4b
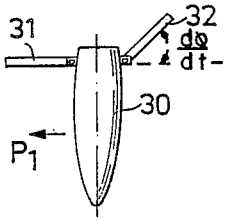
Fig. 5b
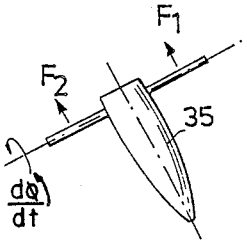
Fig. 6b
Fig. 7a
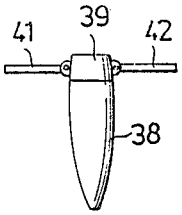
Fig. 7b
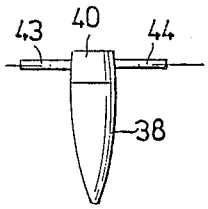

SYSTEM FOR GUIDING A FLYING OBJECT TOWARDS A TARGET

The invention relates to a method for guiding a flying object, which travels in a ballistic trajectory, as a projectile, and which is provided with means for guiding the object towards a target by means of a control signal. The control signal can originate from a target seeker situated in the object for measuring the position of a desired target in relation to the trajectory of the object. Alternatively, the flying object can be commando-guided towards the target or be pre-programmed. Furthermore, the invention relates to a projectile for carrying out the method.

Guidance of a projectile towards a target at the end of the trajectory, so called final phase guidance, is normally effected by means of conventional guidance fins, to which the said control signal is applied. These guidance fins may possibly be combined with or simultaneously serve as roll stabilization fins, so that the final phase guidance can be effected with roll stabilized projectile body.

The conventional guidance fins, which do not noticably influence the speed of the projectile, provide a limited possibility to correct the trajectory in its final phase, because the guidance surface of the projectile is limited. In certain cases there is required a larger correction of the projectile trajectory than what can be achieved by means of such guidance fins.

SUMMARY OF THE INVENTION

The object of the present invention is to propose a guidance principle, which can be used for final guidance of projectiles and which enables larger corrections of the trajectory at the final phase of the same than what is possible with conventional guidance methods.

According to the invention this is achieved thereby that in a given point of the trajectory blades or wings are swung-out from the flying object, as the projectile, which blades are so shaped that they are brought to rotate by their contact with the stream of air past the object, and that the blades are adjusted in dependence upon the control signal for guiding the object towards the target.

The blades or wings, which are driven by the stream of air according to the so called autogiro principle, have two effects. In first hand they will have a braking effect on the projectile, so that its speed can be reduced to a value which is proper for the target seeking phase. Additionally, they can be adjusted for imparting to the projectile a controllable lateral force in order to carry out the correction. With suitable dimensioning of the blades and their setting angles they can be brought to produce an appreciable larger trajectory correction than what can be achieved with conventional guidance fins.

In an embodiment of the method according to the invention, in which the blades are rotatably journalled on the object, the rotational axis of the blades is adjusted to a given angle relative to the length axis of the object. Hereby the object will be imparted a lateral force, which is dependent upon the said oblique setting of the rotational axis relative to the length axis.

In a second embodiment of the method according to the invention the blade angle, i.e. the angle between the individual blades and their rotational axis, is varied periodically in rhythm with their rotation in space.

Hereby the object will be imparted a lateral force, which is dependent upon the said periodic angular variation.

In a further embodiment of the method according to the invention the angle of incidence of the blades, i.e. the angular position of the individual blades around their own length axis, is varied periodically in rhythm with their rotation in space. In this case the object is guided in the same manner as a helicopter without driving of the rotor.

A projectile for carrying out the method, comprising means for guiding the projectile towards a desired target in dependence upon a control signal, is according to the invention characterized thereby, that the said means comprises blades or wings, which in a first phase of the trajectory are situated within the projectile and which can be swung-out in a given point of the trajectory and then are so shaped that they are brought to rotate by their contact with the stream of air along the projectile, actuation means being furthermore arranged for adjusting the blades in dependence of the said control signal for guiding the projectile towards the target.

The invention is illustrated by means of example with reference to the accompanying drawings.

DESCRIPTION OF THE FIGURES

FIG. 3 shows a perspective view of an embodiment of the rotor, FIGS. (4*a*) and (4*b*) illustrate by means of schematic side views the principle for guiding the projectile towards the target in case of a projectile of the embodiment shown in FIGS. 1 and 2, The FIGS. 5A–7B illustrate by means of schematic side views the principle for guiding the projectile towards the target in case of alternative embodiments of the autogiro guidance in accordance with the invention.

DESCRIPTION OF THE PREFERRED EMBODIMENT

Figure 1:
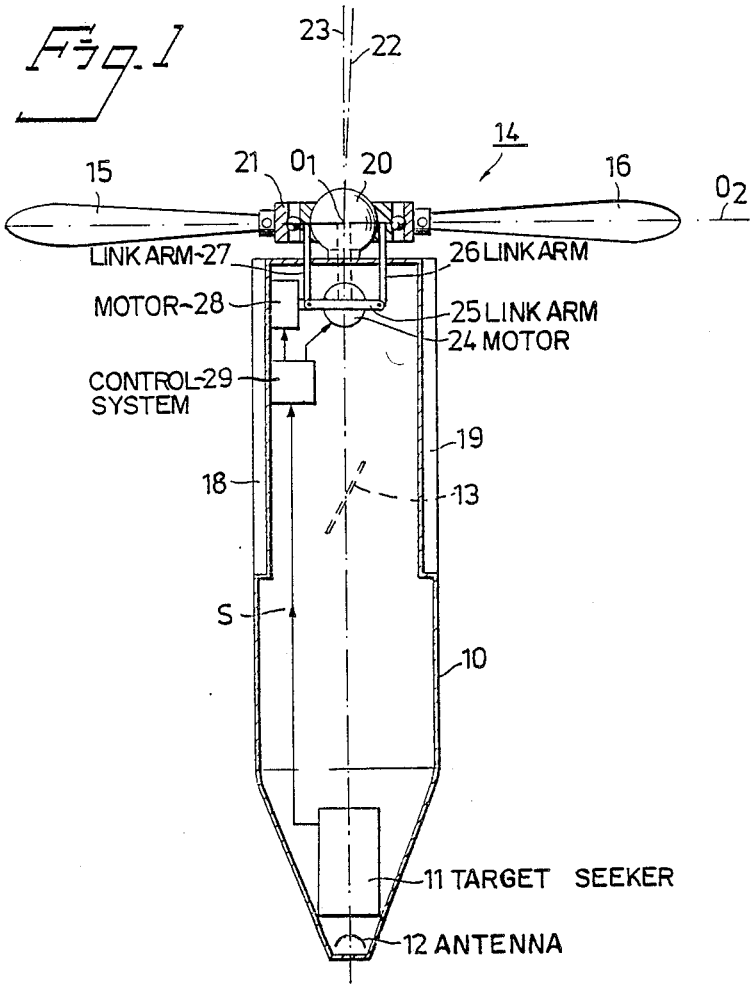
FIG. 1 shows a side view of a projectile comprising a rotor for guiding the projectile towards a target with utilization of the autogiro principle in accordance with the invention.
Figure 2:
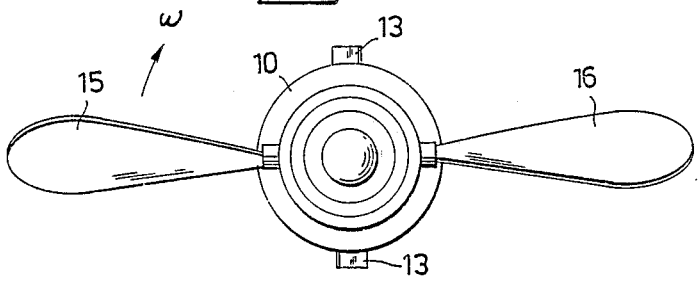
FIG. 2 shows the same projectile as seen from behind.

In FIGS. 1 and 2 reference numeral 10 designates a projectile body, which at its nose has a target seeker 11 with antenna 12 and which in the shown example is provided with roll stabilization fins 13. At the rear part of the projectile there is a rotor 14 consisting of two rotor blades 15, 16. In the embodiment shown in FIG. 3 the rotor blades are interconnected via a hub 17. The rotor blades 15, 16 are pivotally mounted and can be swung forwardly so that they are hidden in pockets 18, 19 in the side of the projectile body. Locking means retain the rotor blades in the hidden position. The locking means can be influenced by a release mechanism for releasing the rotor blades, so that they are swung-out to the shown position. In this position the rotor blades have a fixed angular position relative to the hub and are according to FIG. 3 oblique in the same manner as a propeller. The rotor is journalled on a ball 20 by means of a ball bearing 21, so that it on the one hand can rotate about a rotational axis 22 and on the other hand can vary its rotational axis relative to the projectile axis 23. Adjustment of the rotational axis 22 is effected by turning the whole rotor about two mutually perpendicular axes $O_1$ and $O_2$. Angular setting about the first axis $O_1$ is effected by means of an electric motor 24, which is coupled to the inner ball bearing ring via a mechanical link system comprising link arms 25, 26, 27. Angular setting about the second axis $O_2$ is effected by means of an electric motor 28, which is coupled to the inner ball bearing ring via a similar link system. The link transmission can be of the same embodiment as that described in the Swedish Patent SE 8106754-8, corresponding to U.S. Pat. No. 4,558,325.

The drive currents to the motors 24, 28 are obtained from a drive stage 29, which in turn obtains a control signal S from the target seeker 11. By turning the rotor about the two axes $O_1$ and $O_2$ the rotor shaft is then set in such an angle relative to the length axis of the projectile that the projectile is imparted a force in such direction that the projectile trajectory is displaced in direction towards the desired target. This is illustrated in FIG. 4, where 4A and 4B show the projectile with the rotor blades 15, 16 released but without oblique setting of the rotor axis. The projectile is in this case not influenced by any lateral force and the rotor has only a braking effect. In FIGS. 4A and 4B the rotor axis 22 has been set in an angle $\alpha$ relative to the length axis 23. The projectile will now be imparted a force in the direction indicated by the arrow P and will consequently, besides its motion in the length direction, move in the said direction P. By proper setting of the angle $\alpha$ any error of the projectile trajectory can be corrected, so that the projectile hits the target.

The function is that, after firing the projectile in conventional manner with the rotor blades hidden in the projectile body, the locking means of the rotor blades are influenced during a suitable point of the projectile trajectory, so that the rotor blades are swung-out to the shown position, and the target seeker is activated. The release of the rotor blades can be effected on a time basis as counted from the firing moment or by means of a signal from a distance sensor or the like. By cooperation with the stream of air passing along the projectile the rotor is put into rotation and the projectile is braked to an angular speed w, which is suitable for target seeking and final phase guidance. When the target seeker has found the desired target it delivers such control signals S to the drive stages of the electrical motors that the projectile is guided towards the target by the oblique setting of the rotor.

FIGS. 5A and 5B illustrate another principle for autogiro guidance according to the invention. The rotor blades 31, 32 are in this case fastened directly to the rotor body 30 which is not roll stabilized. The rotor blades shaped as a propeller than will maintain a rotation w of the projectile body, after braking the same to a speed which is suitable for final phase guidance. The rotor blades are mounted so as to be pivotal about two axes 33, 34 which are perpendicular to the length axis of the projectile so that the so called blade angle, i.e. the angle between the length axis of the blade and the rotational axis, can be varied. Within the projectile there are adjustment means, whereby each rotor blade in each moment can be adjusted individually to each desired blade angle. For final phase guidance of the projectile then the blade angle is varied periodically ($d\phi/dt$) in rhythm with the rotation of the projectile in such manner that each blade is swung backwardly when it passes a given part of the revolution, as seen in space, as shown in FIG. (*5b*). Hereby a force will act upon the projectile in a direction indicated by the arrow $P_1$. Along with its motion in the length direction the projectile will consequently move in said lateral direction.

A further embodiment of autogiro guidance in accordance with the invention is shown in FIGS. 6A and 6B. The rotor blades 36, 37 are also in this case fastened directly to the projectile body 35 and the projectile is not roll stabilized. The rotor blades are now adjustable as regards their angle of incidence, i.e. the angle about their own length axis, and co-operate with adjustment means, whereby the angle of incidence can be varied periodically in rhythm with the rotation, in the same manner as in a helicopter. Different large braking forces will act upon the rotor blades in different points of the revolution dependent upon the instantaneous angle of incidence at this position, as illustrated by the arrows $F_1$ and $F_2$ in FIG. (*6b*), and the projectile will make a tipping motion and move in lateral direction.

Variants on the said last two embodiments are shown in FIGS. 7A and 7B. In this case the main part 38 of the projectile body is roll stabilized and has at its rear part a section 39 and 40, respectively, which is rotatable relative to the main body and which supports the rotor blades 41, 42 and 43, 44, respectively. In FIG. (*7a*), the rotor blades 41, 42 are adjustable as regards their blade angle and in FIG. (*7b*) the rotor blades 43, 44 are adjustable as regards their angle of incidence. The blade angle or angle of incidence, is varied periodically during the revolution in the same manner as in FIGS. 5 and 6, respectively, and final phase guidance is effected in previously described manner.

A number of modifications of the described embodiments are possible within the scope of the invention. Thus, the air driven rotor does not need to be situated at the rear part of the projectile but may e.g. be situated at the middle of the projectile. In the transport position and during firing of the projectile the rotor blades can also be swung backwards instead of forwards, as in the shown example. Instead of using one single rotor also two counter-rotating rotors can be arranged. In certain guidance situations, in particular when guiding the projectile towards flying objects, the guidance may instead be based upon that a variation of the rotation axis of the rotor blades will vary the angle of incidence of the projectile itself, i.e. the angle between the length axis of the projectile and the direction of the meeting airstream, and thereby influence the trajectory.

Thus, there has been described a number of embodiments described more particularly by the claims which follow.

What is claimed is:

1. A projectile guiding system for changing the trajectory of a projectile comprising:

a guidance blade pivotally supported to a hub, said guidance blade extending laterally to the axis of said hub;

means connecting said hub to the rearward end of the projectile, permitting said blade and hub to rotate, and for varying the angular position of the rotational axis of said hub about two orthogonal axes;

first and second actuating means coupled to said means connecting said hub for varying the position of said rotational axis of said hub and connected blade about said two orthogonal axes, whereby a lateral force is exerted on said projectile;

a seeker for determining a heading error for said projectile; and, a drive stage connected between said seeker and said first and second actuating means for varying said rotational axis in response to said heading error, whereby said rotational axes is varied to impart a correction force to said projectile.

2. The projectile guiding system of claim 1 further comprising a stabilizing fin supported on said projectile.

3. The projectile guiding system of claim 1 wherein said means connecting said hub and blade to said projectile comprises a link transmission system.

4. The projectile guiding system of claim 1 wherein said first and second actuating means comprises first and second motors connected to said link transmission means.

* * * * *